US005774906A

United States Patent [19]

Ellis et al.

[11] Patent Number: 5,774,906

[45] Date of Patent: Jul. 7, 1998

[54] WAVE POOL CURBING SYSTEM

[75] Inventors: Herbert S. Ellis, Menands; Thomas W. Delp, Ravena; James F. Dunn, Troy; Kenneth L. Ellis, Albany, all of N.Y.

[73] Assignee: Aquatic Amusement Associates, Ltd., N.Y.

[21] Appl. No.: 690,267

[22] Filed: Jul. 24, 1996

[51] Int. Cl.[6] ..... E04H 4/14

[52] U.S. Cl. ..... 4/510; 4/491; 4/497; 52/169.7

[58] Field of Search ..... 4/491, 494, 495, 4/496, 497, 506, 508, 510, 511, 512, 609, 658; 52/169.7; 405/107

[56] References Cited

U.S. PATENT DOCUMENTS

| | | | |
|---|---|---|---|
| 1,404,969 | 1/1922 | Kassebaum | 61/26 |
| 3,546,719 | 12/1970 | Bishop | 4/510 |
| 3,737,921 | 6/1973 | Baumrind | 4/609 |
| 3,813,705 | 6/1974 | Spaulding | 4/511 |
| 4,007,566 | 2/1977 | Molitor | 4/510 |
| 4,080,670 | 3/1978 | Van Den Broek | 4/510 |
| 4,170,796 | 10/1979 | Schiron et al. | 4/491 |
| 4,574,404 | 3/1986 | Stark, Sr. | 4/495 |
| 5,365,619 | 11/1994 | Solomon | 4/609 |

FOREIGN PATENT DOCUMENTS

| | | | |
|---|---|---|---|
| 7400875 | 1/1974 | Germany | 4/491 |

*Primary Examiner*—Henry J. Recla
*Assistant Examiner*—Charles R. Eloshway
*Attorney, Agent, or Firm*—Heslin & Rothenberg, P.C.

[57] ABSTRACT

A foam-like panel which may be removably attached to a pool deck in a manner to provide a planar reflecting surface positioned parallel with the pool wall at a height greater than the upper most portion of the pool wall.

15 Claims, 5 Drawing Sheets

WAVE POOL CURBING SYSTEM

FIELD OF THE INVENTION

The following invention relates to wave pool systems. More particularly, the present invention relates to a wave pool curbing system for improving wave generation within pools.

BACKGROUND OF THE INVENTION

In the past several years, the popularity of wave pools has grown considerably. Today there exists numerous pools specifically designed for the generation and maintenance of waves. However, it will be appreciated that the vast majority of existing pools are primarily designed for swimming and not the maintenance of waves. Nevertheless, pools capable of offering multiple functions, such as a swimming pool and a wave pool, are becoming increasingly popular. This versatility in the function of the pool allows the owner to maximize use of same.

In this regard, there are wave generating systems which have been designed to generate waves in pools that were originally designed for swimming. However, many wave generating systems or devices designed to generate waves in existing swimming pools require extensive structural and mechanical modifications to the pool. Effecting such modifications is expensive and often detracts from the appearance of the pool. Further, even those wave generating devices that function without requiring extensive structural and mechanical modifications to the pool often require that the water level be lowered in the pool prior to generating waves. However, lowering the water level can cause significant health concerns. For example, when the water level is significantly lower than the gutter, the normal flow of water into the gutter is stopped, and, accordingly, the flow of water through the gutter to the filtering, disinfecting and recirculation systems of the pool cannot occur. In addition, repeatedly raising and lowering the water level is itself expensive, requiring additional water tanks or allowing substantial quantities of water to be wasted.

Thus, there exists a need for wave pool systems which allow wave generating devices to be used in connection with standard swimming pool designs without the need for significant mechanical, structural or other modifications to the pool that may prevent the pool from functioning in its intended capacity. There further exists a need for such a wave pool system which will allow the swimming pool to function as either a swimming pool or as a wave pool and that allows for quick and easy conversion between wave-action pools and non-wave action pools. Moreover, there exists a need for such a wave pool system that functions in accord with the working limitations of numerous and varied pool designs and that allows waves to be made without interfering with the filtration, recirculation and disinfectant systems of the pool either during periods of wave action or non-wave action when the system is installed.

SUMMARY OF THE INVENTION

The aforesaid needs are fulfilled and the problems of the prior art overcome by the present invention, which in one aspect, includes a wave pool comprising a swimming pool having a body of water within a pool wall and a removably attachable reflecting panel and/or containment panels positioned along an upper portion of the pool wall wherein a reflecting surface faces the water and extends to a height greater than the uppermost portion of the pool wall. The reflecting panel may be adapted for any one of numerous pool curb designs including pools having an open gutter or no gutter at all. The reflecting panel may extend over a lower lip and above an upper lip of an open gutter such that the reflecting panel contacts the lower lip and is substantially parallel with and in the same plane as the pool wall. The reflecting panel over the lower lip may have a plurality of openings adjacent its interface with the lower lip whereby water from within the pool may enter the gutter. The reflecting panel may have a planar reflecting surface that extends to a height of a few inches to several feet above the normal water level of the pool. In addition, the reflecting panel may have a handhold proximate to the body of water; the handhold may be integrally formed within the reflecting surface or attached to the reflecting surface. The reflecting panel may comprise a semi-rigid or foam-like matter, such as closed cell polyethylene. Means for easily attaching and removing the reflecting panel to and from the pool may be provided.

DESCRIPTION OF THE PREFERRED EMBODIMENT

Figures 1, 1A:
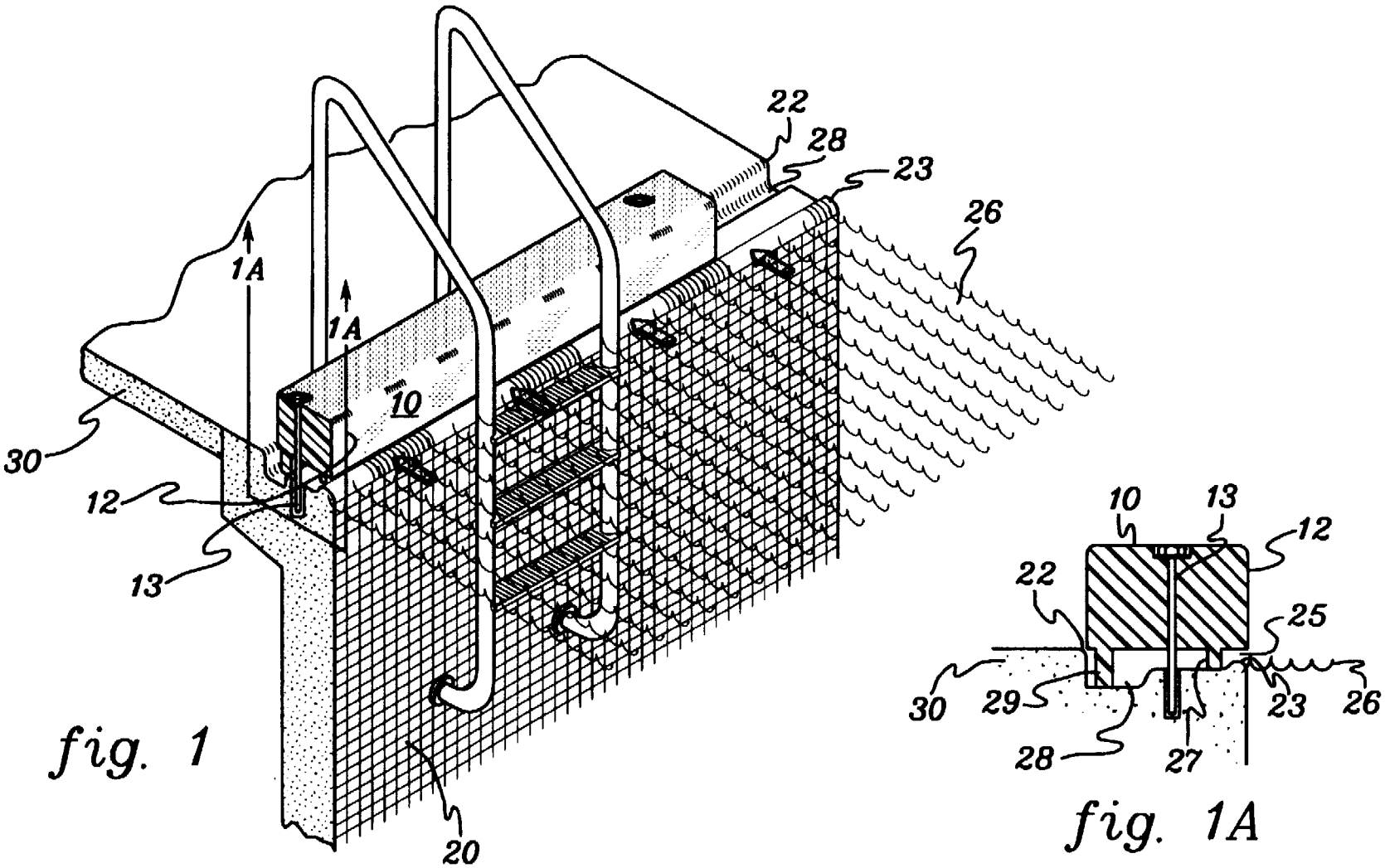
FIG. 1 is a perspective view of a portion of a swimming/wave pool incorporating the subject invention.
FIG. 1A is a cross-sectional view of a portion of FIG. 1 taken on line 1A—1A.

FIG. 1 is a perspective view of a portion of a swimming/wave pool incorporating the subject invention. Vertical wall 20 is an interior wall of the pool which is normally filled with water to operating water level 26. Wall 20 is formed with a lower lip 23 which allows water to spill into gutter 28. Gutter 28 is bounded at the rear by upper lip or shoulder 22 which is formed into deck 30. A reflecting panel 10 is removably bolted into wall 20 by means of bolt assembly 13 shown in greater detail in FIG. 7. It may be seen in FIG. 1(*a*) that there is a gap 25 between lower lip 23 and the adjacent portion of reflecting block 10. Reflecting block 10 includes an inner support rib 27 and an outer support rib 29 which serve to hold block 10 at the proper height above wall 20. Inner support rib 27 is provided with a series of openings (not shown) which allow water to pass from lower lip 23 through inner support rib 27 and into gutter 28. From gutter 28, the water passes through a conventional filtering, disinfecting and recirculation system and is eventually returned to the pool.

It will be readily understood that if one were to generate waves for propagation across the surface of the pool toward wall 20 of FIG. 1, those waves would be reflected by reflecting surface 12 of reflecting panel 10. If reflecting panel 10 were not in place, then the waves would pass over lower lip 23 and be dissipated on deck 30. It has been found that with reflecting panel 10 in place, as shown in FIG. 1, it is possible to generate more sizeable waves with a given wave generator, operating at a given energy level, than would be the case without reflecting panel 10. This appears to occur because reflecting panel 10, and reflecting surface 12 in particular, reflects waves back into the pool and, if the originally generated waves are of an appropriate wave length and if the phasing between the generated waves and the reflected waves is appropriate, the reflected waves will add to the amplitude of the incoming waves. Accordingly, for a given amount of wave generating energy, and without having to lower the water level in the pool from its normal swimming operating level, one can generate waves of greater amplitude using reflecting panel 10 than one can generate without it. It is believed that the physics of this phenomenon are well understood to those skilled in the art. Section 2.53 (pages 2–115 to 2–117) of the U.S. Army Coastal Engineering Center—Shore Protection Manual, Volume I published July 1968 contains a more detailed technical explanation and is incorporated by reference in its entirety.

In essence, the subject invention provides a suitable surface for reflecting incoming waves back into the pool where they may increase the overall amplitude of waves being maintained in the pool.

Thus, the wave action in the pool is enhanced while adequate amounts of pool water are allowed to enter gutter 28 for transport to the filtering, disinfecting and recirculation systems. As a result, the invention provides the same wave enhancing benefits as might be obtained by lowering water level 26 in the pool so as to expose a greater reflecting surface on wall 20. However, use of the invention provides the desired wave enhancement without the disadvantages associated with lowering the water level, as mentioned above.

Those skilled in the art realize that there are a variety of gutter systems used in swimming pools. In some cases as, for example, in FIG. 2, lower lip 23 is directly below upper lip 22 and gutter 24 is recessed in wall 20. A number of these various gutter configurations will now be described with reference to the subject invention. However, it should be understood that the operating principal is essentially the same in each case.

Figure 2:
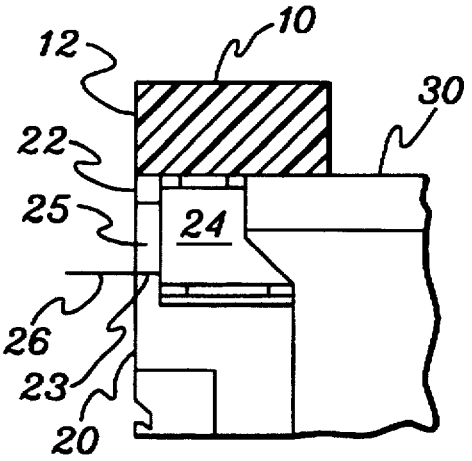
FIG. 2 is a cross-sectional view of a curbing device of the present invention shown installed on a pool having a common type of a gutter system.
Figure 3:
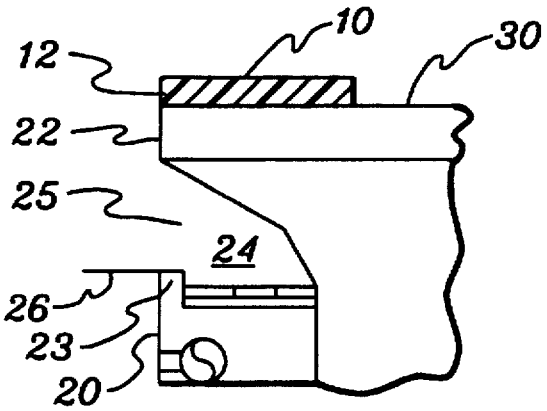
FIG. 3 is a cross-sectional view of a curbing device of the present invention shown installed on a pool having another type of a gutter system.

As shown in reference to FIGS. 2 and 3, when the pool encompasses a design with a vertical gutter opening 25, the reflecting panel 10 may comprise a reflecting surface 12 placed proximate the uppermost portion 22 of the pool wall 20. In the embodiment shown in FIGS. 2 and 3, the reflecting panel 10 comprises a rectangular shaped block that may be removably attached to the pool deck 30 such that a reflecting surface 12 of the block is positioned substantially flush with the upper most portion 22 of the pool wall 20. One can, of course, also provide a reflecting surface to be inserted in opening 25 of the gutter systems shown in FIGS. 2 and 3. Providing such a reflecting surface could be accomplished by attaching a sheet material to the reflecting surface 12 so that the sheet depends downwardly therefrom so as to meet wall 20 at lower lip 23. Alternatively, one could instead merely insert a properly shaped block of material into opening 25 so as to provide a continuous reflecting surface flush with wall 20. As yet another alternative, one could suspend sheet material from upper lip 22 downwardly to lower lip 23 and achieve the same result. Regardless of the approach taken, however, the material covering opening 25 can be provided with perforations or openings in order to allow a reasonable flow of water to enter gutter 24. This concept is discussed with reference to FIGS. 4 and 6 below.

Figure 4:
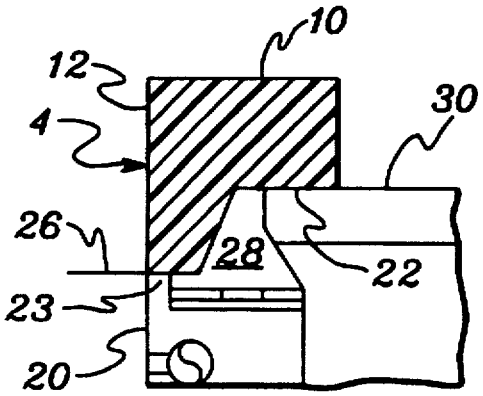
FIG. 4 is a cross-sectional view of a curbing device of the present invention shown installed on a pool having another common type of a gutter system.
Figure 6:
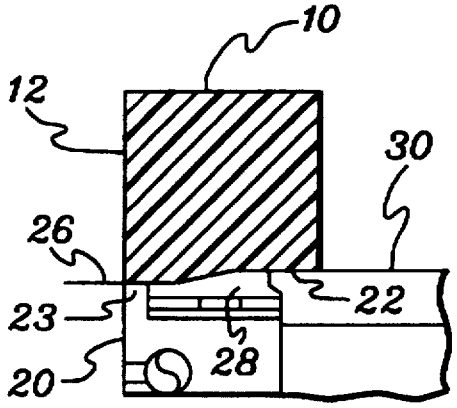
FIG. 6 is a cross-sectional side view of a curbing device of the present invention shown installed on a pool having another common type of a gutter system.

As shown in FIGS. 4 and 6, the present invention may be readily adapted for use with pool designs incorporating various other filtering structures and gutter designs, such as fully-recessed gutters, semi-recessed gutters, rollout gutters and deck-level type gutters. As used herein, the term open gutter section refers to a semi-recessed or deck-level type gutter, such as gutter 28 in which the opening to the gutter 28 is defined by an upper lip 22 and lower lip 23 in which the upper lip 22 is not directly above the lower lip 23, the upper lip 22 being further removed from the pool water than the lower lip 23. Examples of open gutters 28 are shown in FIGS. 1, 4 and 6. In a preferred embodiment with an open gutter, as shown in these figures, the reflecting panel 10 is positioned over both the upper lip 22 and lower lip 23 of the open gutter 28 with a rear portion of the reflecting panel 10 being attached to the pool deck 30. The reflecting panel 10 may extend over the upper lip 22 towards the body of water and may further extend across the gutter opening. The reflecting panel 10 may be positioned over the pool deck 30 and pool wall 20 such that the lower portion of the panel 10 rests on the lower lip 23 thereby placing a reflecting surface 12 adjacent the water and substantially flush with the lower lip 23. When positioned in such a manner; the panel forms a planar reflecting surface substantially parallel to the pool wall, extending a height above that of the upper gutter lip 22, thereby increasing the ability to reflect and maintain waves within the pool without the need to modify the water level 26.

Figure 5:
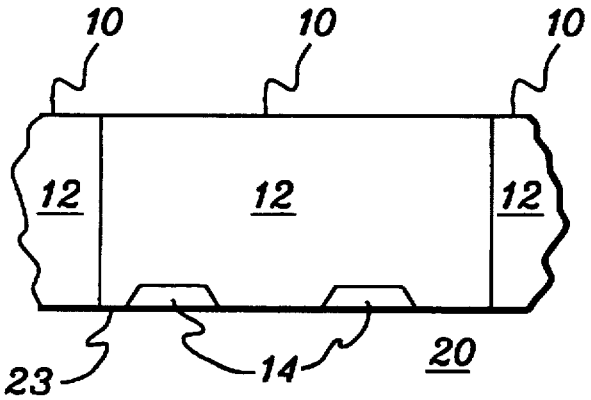
FIG. 5 is a front view of the curbing device of FIG. 4 viewed in the direction of arrow 4.

The reflecting panel 10 may be designed for either closure of the recessed gutter or non-closure of the recessed gutter. For example, in reference to FIG. 5, portions of the reflecting panel 10 directly over the lower lip 23 may have openings 14 therein in order to allow water to enter the gutter 28. This allows the gutter 28 to draw water from the pool and continue to function in its intended capacity. Preferably, the openings 14 are symmetrically placed in a saw-toothed like manner. However, the configuration and spacing of the openings 14 within the panels 10 may vary. Preferably, the openings 14 are uniformly spaced along the interface between reflecting panel 10 and lower lip 23 and are sized to be just large enough to permit a sufficient flow of water into gutter 28 to maintain adequate filtering and disinfecting of the water. There is no advantage in making openings 14 so large that a substantial portion of reflecting surface 12 is lost. Accordingly, the optimum design from the point of view of wave enhancement is to make openings 14 just large enough to accommodate the desired amount of water to flow into gutter 28. Of course, it is not necessary that every reflecting panel incorporate openings. The system could be designed, for example, with a series of reflecting panels laid end to end with alternate ones of these panels having openings and the others none.

The height that the reflecting surface 12 extends above the normal water level 26 and pool wall 20 may be dictated by the specific pool design and the size of the desired waves. Preferably, the upper edge of the reflecting surface is positioned at a height of about 12 to 14 inches above water level 26.

It will be appreciated upon comparison of FIGS. 2, 4 and 6, that the particular configuration of the reflecting panel may be varied in accord with the particular pool design. For example, the reflecting panel 10 may have a more block-like shape when there is less disparity in height between the upper lip 22 and lower lip 23 of the gutter. Further, upon comparison of FIGS. 3 and 6, it will be seen that the height of the reflecting surface 12 may likewise vary in accord with the particular pool design as each of the reflecting panels in FIGS. 3 and 6 provides an extension of the pool wall to a height of about 14 inches above water level 26.

The material comprising the reflecting surface 12 should be a solid material capable of reflecting and containing water. However, preferably the reflecting panel 10 is made of a light semi-rigid material which does not readily absorb water. As used herein, the term "semi-rigid" material refers to a material sufficiently rigid to reflect water yet which is resilient enough such that a person would not be seriously injured upon bumping or striking the reflecting panel. Such semi-rigid materials include foam-like materials, an example being closed cell polyethylene foam. However, there exists numerous other suitable materials such as various plastics, non-corrosive metals and other materials, which may or may not be coated with an outer protective layer, sufficiently rigid and non-corrosive so as to be suitable for use in the present invention. In addition, for safety reasons the corners of the reflecting panel may be rounded.

Figure 7:
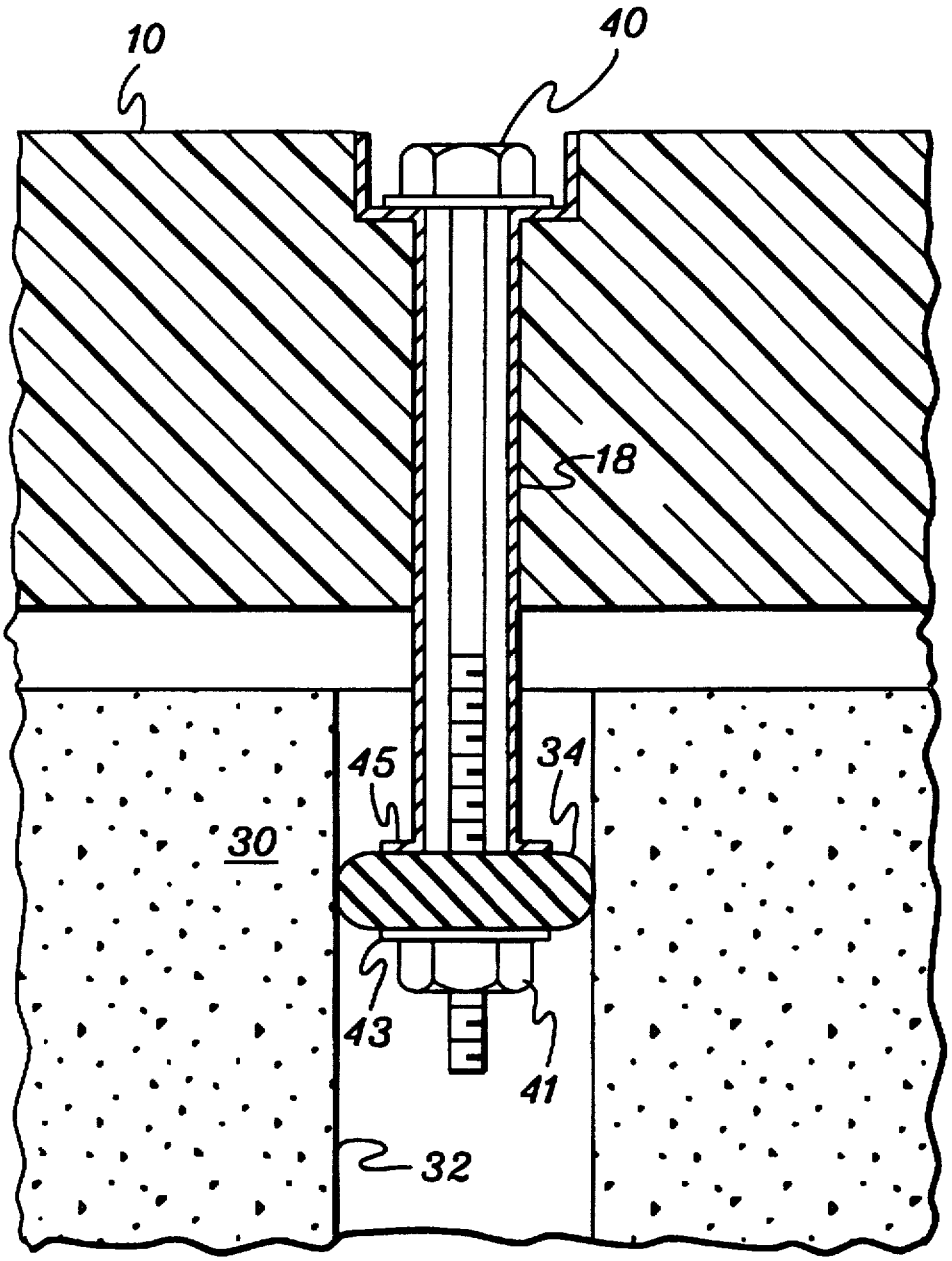
FIG. 7 is an enlarged view of a portion of FIG. 1(A) showing one means for attaching a curbing device of the present invention to a pool deck.

The reflecting panels 10 may be attached to the pool deck 30 by any one of numerous means. For example, the reflecting panel may be attached to the pool deck 30 by a fastener connected to both the panel 10 and the pool deck 30. In FIG. 7, for example, an attachment assembly is shown which is comprised of a bolt 40 contained within a sleeve 18. Sleeve 18 passes through reflecting panel 10 and protrudes about two inches below panel 10. Bolt 40 is provided with a nut 41 at its lower end and rubber bushing 34 is captured between a washer 43 on nut 41 and a flange 45 formed on the lower end of sleeve 18. As bolt 40 is tightened, thus causing nut 41 to be drawn upwardly, rubber bushing 34 is compressed between washer 43 and flange 45, thereby increasing its diameter and causing it to make intimate contact with and press against the interior of socket 32 which is formed in deck 30. As a result, panel 10 becomes locked in place. It will be appreciated that such a fastening mechanism can be quickly deployed and removed. Of course, the reflecting panel 10 may be removably attached to the pool deck via other means of attachment, including, but not limited to, latches, hooks, hook and eye type fasteners such as those sold under the Velcro® trademark.

Figure 8:
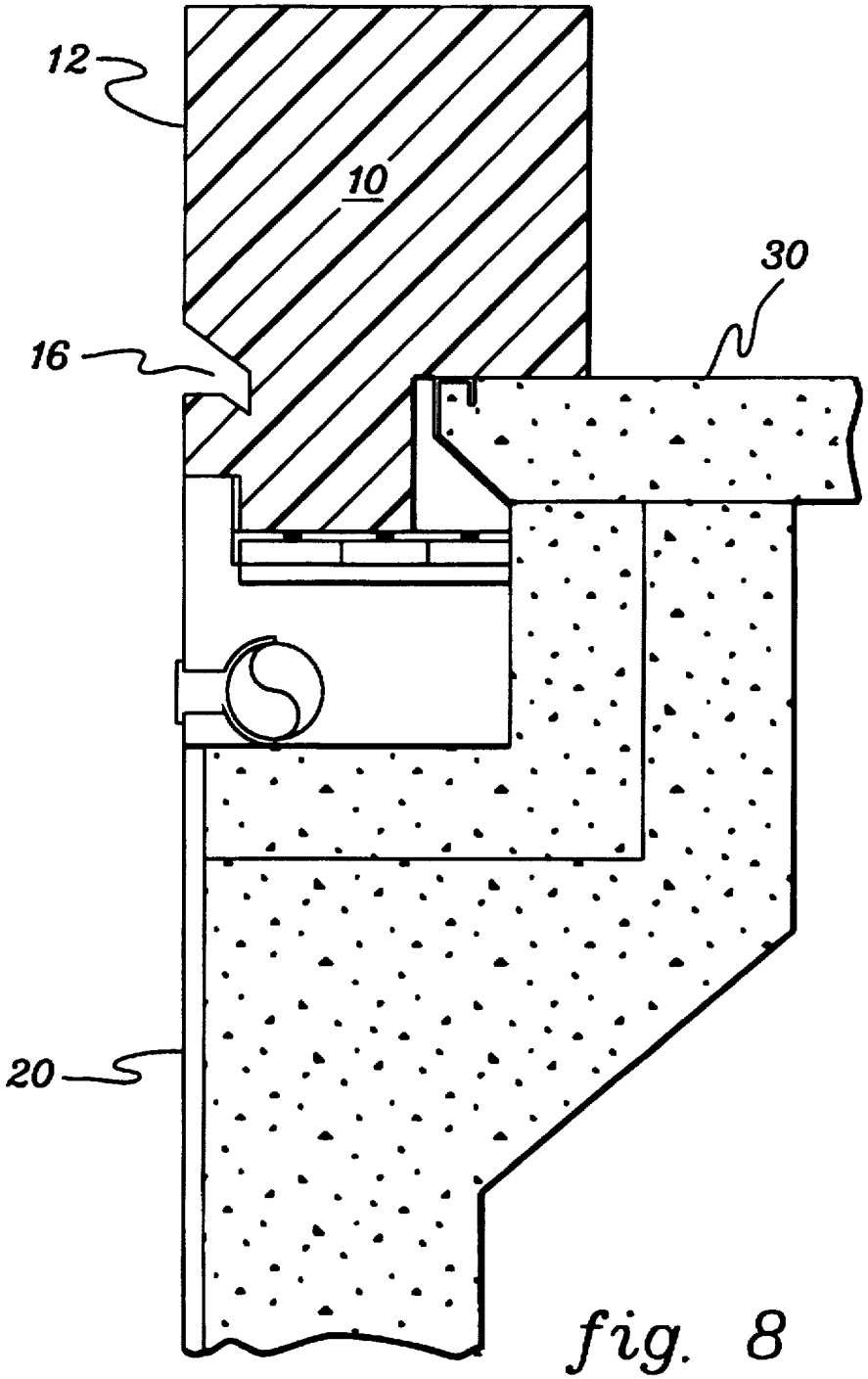
FIG. 8 is a cross-sectional view of a curbing device of the present invention incorporating a hand hold.

In reference to FIG. 8, the reflecting panel may have a hand hold or handle 16, proximate the pool water, capable of supporting persons within the water and/or aiding a person exiting the pool. The handle may be integrally formed within the material comprising the reflecting panel, as shown in FIG. 8, or a separate handle may be attached to reflecting panel 10.

Figure 9:
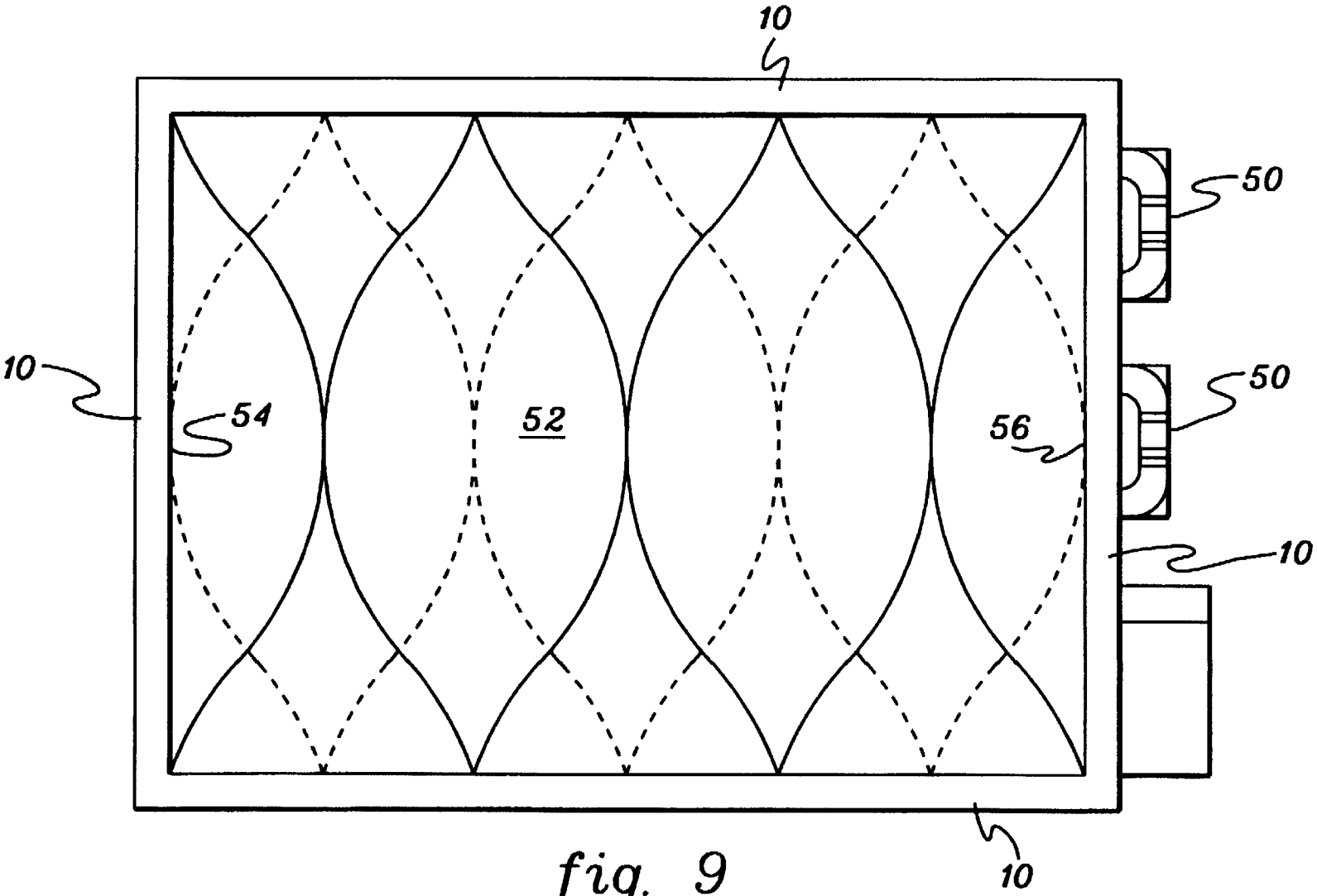
FIG. 9 is a top view of a pool employing a curbing device of the present invention.

FIG. 9 is a plan view of a pool showing a plurality of reflecting panels 10 installed end to end along its perimeter. Although the pool in FIG. 9 is rectangular, it will be appreciated that other pool shapes can be used with the subject invention. Pool 52 shown in FIG. 9 is provided with wave generators 50 at one end. Thus, waves are propagated from wave generators 50 to the opposite end of the pool where they are reflected and returned toward wave generators 50. Panels 10 may incorporate notices to swimmers indicating the depth of the pool or placing restrictions on diving or other activities, especially where such notices on the pool itself would be covered when panels 10 are installed.

Pools designed to provide a body of water for swimming exist in a vast number of configurations. Such pools range in sizes for private use, such as those in an individual's backyard, to much larger pools designed for serving the public at large. Swimming pools often incorporate both shallow sections for wading and a deeper section which allows a person to freely swim without touching the pool bottom. However, the specific configuration of the pool is not believed to be critical as the present invention may be adapted and used in connection with pools of almost any size or design.

There are numerous wave generating systems and wave generating devices which may be used to generate waves within standard swimming pool designs. Examples of such systems and devices are the "Waveball" manufactured by S. A. WOW Co. of Belgium and the Wave Generating System taught in U.S. patent application Ser. No. 08/397,970; the contents of the aforesaid '970 application are incorporated herein by reference. As with pool design, the particular wave generating system or wave generating device is not believed to be critical as one skilled in the art will appreciate that the present invention may be used in connection with numerous types of wave generating systems and/or devices.

Thus, the present invention provides a means of extending the height of the pool wall, relative to the water level, in order to allow the generation of waves in the swimming pool without the need to lower the water level. This has significant advantages in that it will not detract from the water quality maintenance systems since the water level may be maintained at the level originally designed for that particular pool. Moreover, the time and expense in raising and lowering the water level of the pool is completely avoided.

While the invention has been particularly shown and described with reference to the preferred embodiments thereof, it will be understood by those skilled in the art that other changes in form and details may be made therein without departing from the spirit and scope of the invention.

We claim:

1. A swimming/wave pool comprised of:

a pool defined, at least in part, by a vertical wall having an upper end, said pool adapted to be filled with water up to a certain operating level for swimming;

a gutter in the wall wherein said gutter has a lip proximate the water operating level;

a selectively activatable wave generator associated with the pool and adapted to propagate waves in the pool toward the vertical wall;

at least one wave reflecting panel removably mounted to the wall for use during wave generation, said panel having a reflecting surface which extends at least upwardly from the lip to a preselected height, having at least one opening therethrough, at least a portion of which opening is proximate the lip so as to permit water from the pool to flow over the lip into the gutter.

2. The swimming/wave pool of claim 1 wherein the panel is made of a semi-rigid material.

3. The swimming/wave pool of claim 2 wherein the semi-rigid material is closed cell polyethylene foam.

4. The swimming/wave pool of claim 1 wherein the panel includes a handhold adjacent the pool.

5. The swimming/wave pool of claim 1 wherein the upper end of the wall forms a portion of a substantially horizontal deck and the panel is removably mounted to the deck.

6. The swimming/wave pool of claim 5 wherein the panel is attached to the pool by means of a bolt assembly passing through the panel into a socket formed in the deck.

7. The swimming/wave pool of claim 6 wherein the bolt assembly includes a resilient bushing positioned in the socket upon attachment of the panel to the deck, said bolt assembly being adapted to compress the bushing as the bolt is tightened so as to increase the diameter of the bushing and cause it to engage the socket.

8. A wave reflecting device for use with a swimming/wave pool during wave generation, said pool having a certain water operating level and being of the type defined, at least in part, by a vertical wall with an upper end toward which waves are to be propagated, wherein said wall has a gutter formed therein, and said gutter has a lip proximate the said water operating level, said device comprising:

a reflecting panel having a wave reflecting surface, said panel adapted to be removably mounted to the pool so that the reflecting surface when so mounted extends at least upwardly from the gutter, said panel having at least one opening through the reflecting surface, a portion of said opening being positioned so as to be proximate the lip, thereby permitting water to flow from the pool across the lip and into the gutter.

9. The wave-reflecting device of claim 8 wherein the panel is made of a semi-rigid material.

10. The wave-reflecting device of claim 9 wherein the semi-rigid material is closed cell polyethylene foam.

11. The wave-reflecting device of claim 8 wherein the panel includes a handhold adjacent the pool.

12. The swimming/wave pool of claim 8 wherein said pool has a deck proximate the upper end of the wall and said reflecting panel is adapted to be removably anchored to the deck.

13. The wave-reflecting device of claim 12 wherein the panel is attached to the pool by means of a bolt assembly passing through panel into a socket formed in the deck.

14. The wave-reflecting device of claim 13 wherein the bolt assembly includes a resilient bushing positioned in the socket upon attachment of the panel to the deck, said bolt assembly being adapted to compress the bushing as the bolt is tightened so as to increase the diameter of the bushing and cause it to engage the socket.

15. A method for enhancing the wave reflecting ability of a swimming pool wall without having to lower the water level in the pool below its normal operating level, wherein the pool wall includes a gutter, said gutter having a lip for permitting water from the pool at its normal operating level to spill into the gutter comprising the step of:

adding a wave reflecting surface to the pool wall and wherein the added reflecting surface meets and extends at least above the lip and is provided with openings, a portion of said openings meeting the lip so as to permit water from the pool to enter the gutter.

* * * * *